United States Patent [19]

Jongerling et al.

[11] Patent Number: 4,474,367

[45] Date of Patent: Oct. 2, 1984

[54] SHEET HANDLING APPARATUS AND METHOD OF SHEET HANDLING FOR SELECTIVE REMOVAL OF SHEETS FROM A VACUUM DRUM

[75] Inventors: Henry W. Jongerling, Plano; Svetislav Mitrovich, Dallas, both of Tex.

[73] Assignee: The Mead Corporation, Dayton, Ohio

[21] Appl. No.: 355,809

[22] Filed: Mar. 8, 1982

[51] Int. Cl.[3] ..... B65H 29/32

[52] U.S. Cl. ..... 271/197; 198/689; 271/276

[58] Field of Search ..... 271/197, 196, 194, 276, 271/300, 279, 283, 284, 96, 108; 226/95; 198/438, 689

[56] References Cited

U.S. PATENT DOCUMENTS

| | | | |
|---|---|---|---|
| 1,838,200 | 12/1931 | Tomtlund | 271/196 |
| 2,184,229 | 12/1939 | Spiess | 271/27 |
| 2,969,869 | 6/1961 | Klinger | 271/197 X |
| 3,336,028 | 8/1967 | Schonmeier | 271/74 |
| 3,389,907 | 6/1968 | Turner | 271/74 |
| 3,431,139 | 3/1969 | Stroszynski | 117/119.8 |
| 3,477,558 | 11/1969 | Fleischauer | 271/197 X |
| 3,545,746 | 12/1970 | Ledger et al. | 271/197 X |
| 3,669,446 | 6/1972 | Derc et al. | 271/29 |
| 3,845,951 | 11/1974 | Namaker | 271/243 |
| 3,978,642 | 9/1976 | Smithers | 53/159 |
| 4,062,535 | 12/1977 | Charbonnet | 271/197 X |
| 4,157,177 | 1/1979 | Strecker | 271/197 |
| 4,216,954 | 8/1980 | Kwasnitza | 271/283 |
| 4,261,559 | 4/1981 | Mitzel | 271/196 |

OTHER PUBLICATIONS

IBM Technical Disclosure Bulletin—Document Transport Mechanism, vol. 15, No. 12, May 1973–Thorpe, pp. 3602–3603.

*Primary Examiner*—Bruce H. Stoner, Jr.
*Assistant Examiner*—John A. Carroll
*Attorney, Agent, or Firm*—Biebel, French & Nauman

[57] ABSTRACT

A sheet handling apparatus includes a rotatable hollow sheet transport drum with a plurality of openings extending therethrough, vacuum supply for supplying a partial vacuum to the interior of the drum, a drive for rotating the drum, and a stationary deflection plate disposed adjacent the outer drum surface. A vacuum shield is mounted within the drum and is movable from a first position, remote from the inner wall of the drum, to a second position, adjacent the wall. The shield, when in its second position, prevents the partial vacuum from being applied to the leading portion of a sheet on the drum so as to permit the leading edge of the sheet to deflect outwardly from the drum and strike the deflection plate.

5 Claims, 4 Drawing Figures

SHEET HANDLING APPARATUS AND METHOD OF SHEET HANDLING FOR SELECTIVE REMOVAL OF SHEETS FROM A VACUUM DRUM

BACKGROUND OF THE INVENTION

The present invention relates to a sheet handling apparatus and a method of sheet handling and, more particularly, to such apparatus and method for transporting cut sheet paper along a predetermined path and for selectively directing individual sheets to a second, divergent path. Such apparatus and method may find particular application in printing systems, where the sheets are selectively transported to various components of the printing device. At various points along the path, it may be necessary or desirable to provide divergent paths for removing damaged sheets, routing specific sheets to alternate outputs, returning sheets to a printing station for printing on a second side, sorting or re-ordering the sheets, or the like.

There are several methods presently known whereby a sheet may be diverted mechanically from a first path into a second path. Diverting plates may be moved into the path of the sheets to deflect the sheets out of their original path and into a second path. Alternatively, rollers may be moved into contact with the sheets so as to feed the sheets into the divergent path. Such methods may not be appropriate, however, where the sheets are travelling at relatively high speeds. It is extremely difficult to move a high mass mechanical deflection system quickly enough so as to divert a single, selected sheet without affecting the normal flow of the preceding and following sheets through the sheet path.

It is also well known to transport sheets by means of a hollow drum having openings along its surface and a partial vacuum applied to its interior. The drum is rotated and one or more sheets are fed onto the drum, adhering to its surface due to the partial vacuum applied to the sheets through the openings. The sheets are then carried by the rotation of the drum.

The sheets may be removed from the drum by any of several known methods. Mechanical means are known whereby an actuator mechanism located adjacent the drum pivots several deflection fingers into grooves defined by the surface of the drum, such that the leading edges of the fingers are below the drum surface. The fingers effectively peel the sheets from the drum surface. Such a system is disadvantageous for use in a high speed sheet handling apparatus, since the mechanism must be pivoted very quickly. Moreover, precise recognition of the leading and trailing edges of the sheets is required in order to time the actuation of the mechanism.

In U.S. Pat. No. 1,838,200, issued Dec. 29, 1931, to Tomtlund, the openings in a vacuum drum are connected by a series of lateral passageways just under the exterior surface of the drum. By use of fixed baffles placed in the ends of the drum, the passageways communicate with the partially evacuated interior of the drum during the portion of the drum's rotation in which sheets are fed onto the drum. During that portion of the drum's rotation in which the sheets are to be released, the passageway communicates with the atmosphere. With no vacuum exerted upon the sheets, the sheets are released and removed from the drum by their own weight.

In U.S. Pat. No. 3,669,446, issued June 13, 1972, to Derc et al, a baffle plate is mounted within a vacuum drum adjacent the inner surface thereof at the point where a sheet is to leave the surface of the drum. The plate, by blocking the openings in the drum surface adjacent thereto, prevents the vacuum from reaching the sheet, and the sheet is thereby released from the drum.

Neither of these methods is suitable for selectively releasing a particular sheet from a vacuum drum, and diverting it to an alternate path. In the Tomtlund '200 patent, the means for disconnecting the passageways from the partial vacuum is an integral part of the drum and its support, and operates in a noncontrollable fashion such that selective sheet release may not be obtained. In the Derc '446 patent, the plate is fixed in place, such that every sheet is released from the drum at the same point along the drum's rotation.

In U.S. Pat. No. 4,216,954, issued Aug. 2, 1980, to Kwasnitza, an apparatus is disclosed for selectively diverting a particular sheet to an alternate path. A rotatable hollow drum having openings along its surface is positioned at the juncture of two sheet paths. The paths are formed by endless conveyor belts, some of which pass over the drum, thereby rotating it. A rotatable chamber is located in the interior of the drum, communicating with its inner surface, and may be selectively connected to either a partial vacuum source or a source of slightly compressed air. The chamber is rotated so that it meets the leading edge of each successive incoming sheet as the sheet approaches the drum. If the sheet is to continue in the first path, the chamber is connected to the source of slightly compressed air, so that air emitted through the openings in the drum will urge the leading edge of the sheet away from the drum, thereby causing the sheet to remain in the first path. If the sheet is to be diverted to the second path, the chamber is connected to the partial vacuum source. The vacuum is applied to the leading edge of the sheet through the openings in the drum, thereby carrying the sheet along the drum surface to the entrance to the second path.

While the device disclosed in the Kwasnitza '954 patent does provide for diverting selected sheets to an alternate path, there are several disadvantages inherent in this device. Most apparent is the relative complexity of the apparatus, requiring both a rotating drum and a rotating chamber. Further, sources of both compressed air and partial vacuum must be provided. Additionally, the rotational speed of the chamber must be precisely timed so that the chamber meets the leading edge of each sheet as the edge approaches the drum, and means must be provided to vary the speed of the chamber in order to handle sheets of different sizes.

It is seen, therefore, that a relatively simple means of diverting selected sheets from a transport path into an alternate path is needed. Such a means should provide diversion at relatively high speed without interruption to the normal flow of preceding and succeeding sheets, and should be operable regardless of the size of the sheets or spacing between successive sheets. Moreover, such a means should divert selected sheets with minimal risk of damage to those sheets.

SUMMARY OF THE INVENTION

A sheet handling apparatus includes a rotatable hollow drum, defining a cylindrical sheet transport surface and further defining a plurality of openings which extend through the sheet transport surface and communicate with the interior of the drum. Means for supplying a partial vacuum to the interior of the drum is provided, for application through the openings to a sheet on the sheet transport surface. The apparatus includes means for rotating the drum, and a stationary deflection plate disposed adjacent the sheet transport surface. A vacuum shield means is mounted within the drum, and is movable from a first position remote from the inner wall of the drum to a second position adjacent the wall. When the vacuum shield means is in the second position, the partial vacuum is prevented 15 from being applied to a sheet on the sheet transport surface through a number of the openings adjacent the deflection plate. Means for selectively moving the vacuum shield means between the first and second positions is provided. When the vacuum shield means is in the second position, a sheet supported on the sheet transport surface deflects outwardly from the surface and contacts the deflection plate, such that the sheet is then removed from said surface.

The vacuum shield means may comprise a curved shield plate fittable against the inner surface of the drum. The means for selectively moving the vacuum shield means may comprise a solenoid actuator, mounted within the drum and attached to the vacuum shield means.

The means for rotating the drum may comprise a roller disposed such that the longitudinal axis of the roller is parallel with respect to the longitudinal axis of the drum. A plurality of sheet transport belts extend between and around the roller and drum, such that rotation of the roller drives the belts and drum.

Accordingly, it is an object of the present invention to provide a sheet handling apparatus and a method of sheet handling in which selected ones in a succession of sheets transported on a curved sheet transport surface may be removed therefrom; to provide such an apparatus and method in which the sheets are held on the surface by means of a partial vacuum applied thereto through a plurality of holes in the surface; to provide such an apparatus and method in which a vacuum shield is movable to terminate selectively the application of the partial vacuum through the holes; to provide such an apparatus and method in which a stationary deflection plate is provided adjacent the surface to 15 contact sheets as they are released from the surface and to assist in their removal therefrom; to provide such an apparatus and method in which a single sheet may be diverted from the normal sheet transport path at relatively high speed without interruption to the normal flow of succeeding sheets; to provide such an apparatus which is simple in both design and construction; to provide such an apparatus and method which are operable regardless of the size of the sheets or spacing between successive sheets; and to provide such an apparatus and method for selectively diverting a single sheet from a sheet transport path with minimal risk of damage to the sheet.

Other objects and advantages of the invention will be apparent from the following description, the accompanying drawings, and the appended claims.

DETAILED DESCRIPTION OF THE PREFERRED EMBODIMENT

Figure 1:
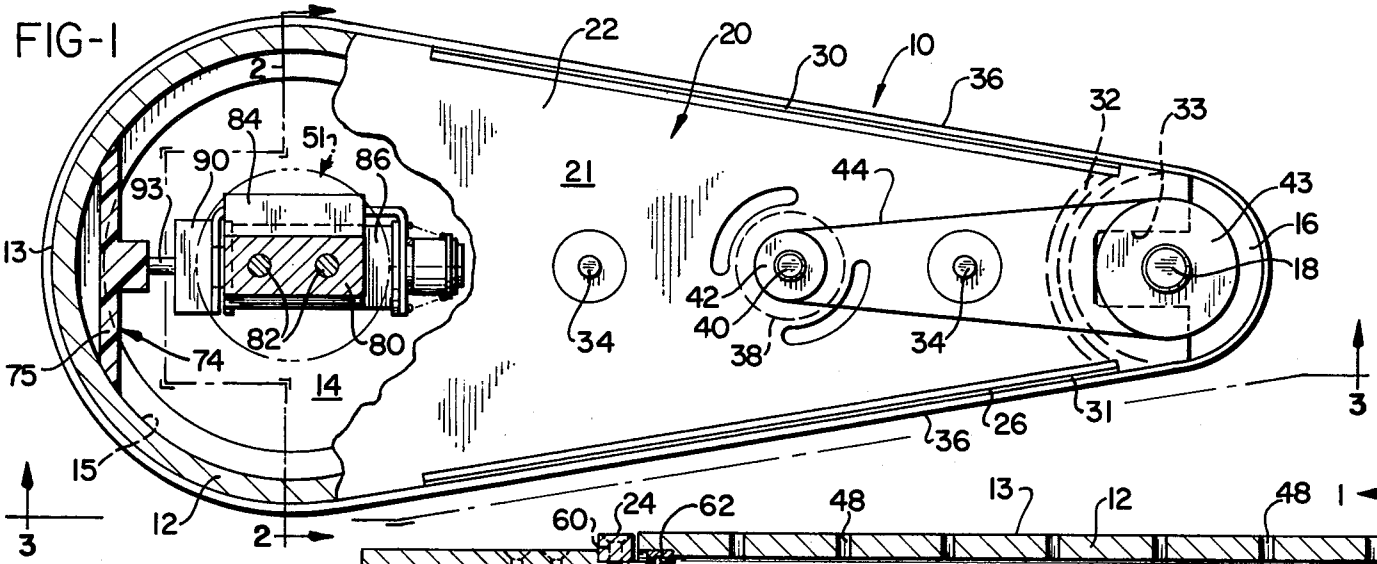
FIG. 1 is a side view, with a portion of the side frame broken away along line 1—1 of FIG. 2, of the sheet handling apparatus of the present invention.

FIG. 1 is a side view of a sheet handling apparatus 10 constructed according to the present invention. A rotatable hollow drum 12, defining a cylindrical sheet transport surface 13, an inner cavity 14, and a cavity wall 15 is disposed at one end of the apparatus 10, while a cylindrical roller 16 of substantially the same length as drum 12 is disposed at the opposite end. Roller 16 is fixedly mounted to a shaft 18.

Figure 3:
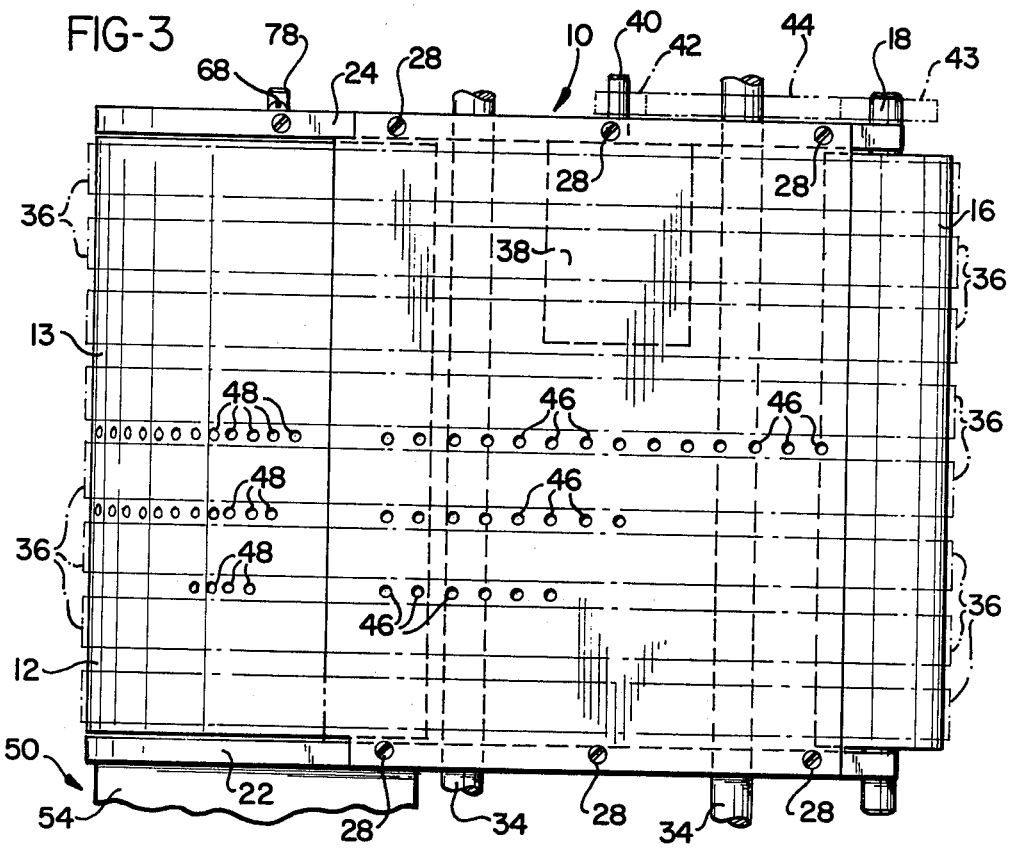
FIG. 3 is a bottom view, taken generally along line 3—3 in FIG. 1.

As shown in FIGS. 1 and 3, a vacuum plenum 20 is disposed between drum 12 and roller 16. An inner cavity 21 of plenum 20 is defined by side plates 22 and 24, a lower plate 26 attached to side plates 22 and 24 by screws 28, and an upper plate 30 similarly attached to side plates 22 and 24. Lower plate 26 defines a planar sheet transport surface 31. A curved end wall 32 closes plenum 20 at the end thereof adjacent roller 16. Side plate 22 defines a cut-out portion 33 at one end thereof through which shaft 18 passes. Side plate 24 defines a similar cut-out portion (not shown). Support bars 34 are provided, attached to side plates 22 and 24 and extending through plenum cavity 21, to facilitate attachment of the sheet handling apparatus 10 to a printing device or the like. Additionally, shaft 18, and thus roller 16, is rotatably supported by bearing means (not shown) within the printing device.

Several sheet transporting belts 36 extend around roller 16, across lower plate 26, around drum 2 and across upper plate 30. Means for rotating roller 16 includes motor 38, mounted to side wall 22 within plenum cavity 21. Motor 38 has a drive shaft 40 extending through side plate 22. A pulley 42 is attached to shaft 40 outside plenum 20, and a pulley 43 is mounted to shaft 18. A drive belt 44 extends around and between pulleys 42 and 43, such that motor 38 drives pulley 42, belt 44, and hence pulley 43. Pulley 43 in turn drives shaft 18, rotating roller 16. The means for rotating roller 16, as well as roller 16 and belts 36, comprise a means for rotating drum 12; rotation of roller 16 drives belts 36, which in turn rotates drum 12.

As partially shown in FIG. 3, a plurality of openings 46 extend through lower plate 26 and upper plate 30 in the spaces between belts 36 and communicate with plenum cavity 21. Similarly, a plurality of openings 48 extend through drum 12 in the spaces between belts 36 and communicate with cavity 14 of drum 12. A means for supplying a partial vacuum 50 is mounted within one end of drum 12 so as to evacuate partially cavity 14. Further, since plenum 20 is open at the end thereof adjacent drum 12, the vacuum supply means 50 will partially evacuate plenum cavity 21 through those openings 48 in drum 12 which are in communication with plenum 20.

Figure 2:
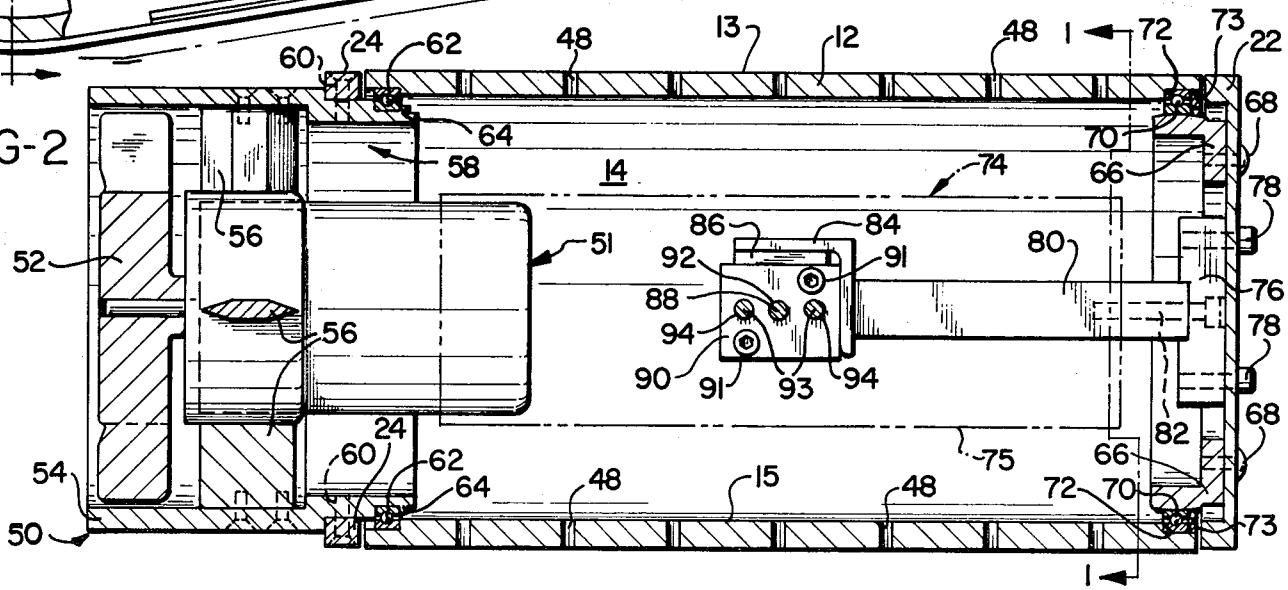
FIG. 2 is a sectional view, taken generally along line 2—2 in FIG. 1.

As shown in FIG. 2, the vacuum supply means 50 includes a vacuum motor 51 and exhaust fan assembly 52 and a shroud 54. Motor 51 and assembly 52 is mounted within shroud 54 by mounting brackets 56 so that motor 51 and fan assembly 52 drive air outwardly from drum cavity 14 and hence from plenum cavity 21. Side plate 24 defines a circular opening 58 therein concentric with and of substantially the same diameter as drum cavity 14. Shroud 54 is fitted through opening 58, extending into cavity 14, and is attached to side plate 24 by screws 60. Ball bearings 62 are fitted about the end of shroud 54 that extends into cavity 14 and are retained there by pins 64 which are pressed into openings in shroud 54. Drum 12 is freely rotatable about shroud 54.

Referring again to FIG. 2, side plate 22 encloses the end of drum 12 opposite the vacuum supply means 50. An annular bearing cap 66, disposed concentrically with drum 12, is attached within the end of drum 12 to the inside of plate 22 by screws 68. Ball bearings 70 are fitted about bearing cap 66, and further fit into a notch 72 defined within the inner edge of drum 12, retained therein by an annular retaining ring 73.

As shown in FIG. 1, a vacuum shield means 74 is mounted within drum cavity 14, and includes a curved shield plate 75, movable from a first position remote from the inner wall 15 of drum 12 to a second position adjacent wall 15. The second position, in which shield plate 75 is shown in FIG. 1, is suitably close to the inner wall 15 of the drum 12 so as to prevent the partial vacuum within cavity 14 from being applied to those openings 48 in drum 12 which are adjacent shield plate 75 at any particular time, but not so close as to interfere with the rotation of drum 12.

Referring now to FIGS. 1 and 2, a means for selectively moving vacuum shield means 74 between the first and second position includes a circular disk 76, mounted to the inner surface of plate 22 within cavity 14 by screws 78. A spacer member 80 is mounted at one end to disk 76 by screws 82 so as to extend into cavity 14. A mounting bracket 84 is attached to the opposite end of spacer member 80. A solenoid 86 having a movable actuator arm 88 is mounted to bracket 84 such that solenoid actuator 88 is disposed at a right angla to the axis of rotation of drum 12. A guide block 90 is attached by screws 91 to solenoid 86 such that actuator arm 88 passes through opening 92 defined therein and is guided thereby. Curved shield plate 75 is attached to and movable by actuator 88, and hence by solenoid 86. Additionally, two guide pins 93 are press-fitted into openings 94 defined within guide block 90. Pins 93 communicate with holes (not shown) defined within and extending partially through shield plate 75, so as to maintain proper orientation of plate 75 within cavity 14.

Figure 4:
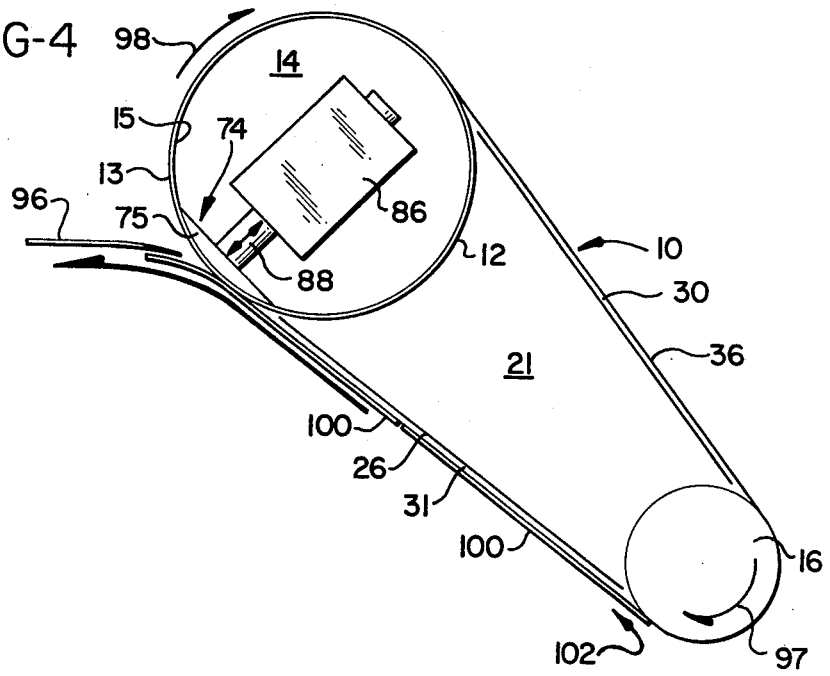
FIG. 4 is a schematic side view, illustrating the operation of the sheet handling apparatus.

The sheet handling apparatus 10 is illustrated schematically in FIG. 4, and further includes a deflection plate 96 fixedly disposed adjacent drum 12. It will be understood, comparing FIGS. 1 and 4, that the vacuum shield means may be oriented in any direction within a plane parallel to the axis of rotation of drum 12, so long as curved shield plate 75 is not disposed adjacent plenum 20 when in the second position. Further, deflection plate 96 will be disposed adjacent the area along the rotational path of drum 12 which may be shielded by curved shield plate 75.

The operation of the sheet handling apparatus 10, shown in FIG. 4, is described below. Roller 16 is rotatably driven in a direction indicated by arrow 97, thereby driving belts 36 and drum 12 in a direction shown by arrow 98. Sheets 100 are fed onto the sheet handling apparatus from a sheet input, indicated generally at 102, and held to belts 36 by the partial vacuum within plenum cavity 21, applied to sheets 100 through openings 46 in lower plate 26. Sheets 100 are carried along plate 26 by belts 36.

When curved shield plate 75 is in its first position remote from the inner wall 15 of drum 12, sheets 100 carried by belts 36 beyond plate 26 will continue to adhere to belts 36 by virtue of the partial vacuum now applied to sheets 100 through openings 48 in drum 12. Sheets 100 are thereby carried by belts 36 around drum 12 along transport surface 13 and over upper plate 30 to a sheet output (not shown), whereupon sheets 100 are removed from and leave sheet handling apparatus 10. 15 Upon appropriate signal from a control means (not shown), solenoid 86 may be energized, thereby causing actuator arm 88 to move shield plate 75 to its second position adjacent the inner wall 15 of drum 12. As the leading edge of a sheet 100 is moved by belts 36 along the rotational path of drum 12 adjacent shield plate 75, no vacuum is applied to the leading portion of the sheet. The leading edge of the sheet then moves away from drum 12 along a line approximately tangent to the transport surface 13 of drum 12. Belts 36 continue to carry the remainder of sheet 100 along, causing the leading edge to contact and be guided by deflection plate 96. Belts 36 carry sheet 100 until it has been completely removed from drum 12 by deflection plate 96.

It will be recognized from the above description of the operation of the sheet handling apparatus 10 that the path of the leading edge of a sheet is determinative of the path taken by the entire sheet. Thus, movement of shield plate 75 from its first, non-shielding position to its second, shielding position after the leading edge of a sheet has been carried beyond the shielded area of drum 12, but before the remainder of the sheet has been carried past, will not cause the sheet to be deflected from its path along transport surface 13 of drum 12. Similarly, removal of shield plate 75 from its second position to its first position after the leading edge of a sheet has contacted deflection plate 96, but before the remainder of the sheet has been deflected, will not affect the deflection of the sheet from drum 12. Therefore, it is not critical that the apparatus distinguish precisely between the trailing edge of a sheet and the leading edge of a successive sheet, nor must the vacuum shield means 74 be able to operate within a length of time between which the trailing edge of a sheet and the leading edge of the succeeding sheet are carried past the shielded portion of drum 12.

While the form of the method herein described, and the form of apparatus for carrying this method into effect, constitute preferred embodiments of the invention, it is to be understood that the invention is not limited to this precise method and form of apparatus, and that changes may be made in either without departing from the scope of the invention.

What is claimed is:

1. A sheet handling apparatus, comprising:

a rotatable drum defining an interal cavity, a cylindrical sheet transport surface, and a plurality of opening extending through said sheet transport surface and communicating with said cavity, means for supplying a partial vacuum to said cavity of said drum, such that said partial vacuum may be applied through said openings to a sheet on said sheet transport surface, said means for supplying a partial vacuum comprising a motor, having a shaft, said motor being mounted in one end of said drum, and an exhaust fan mounted on said shaft and driven by said motor such that the direction of air flow caused by said fan is outwards from said cavity of said drum, means for rotating said drum, a stationary deflection plate disposed adjacent said sheet transport surface, a vacuum shield means mounted in said cavity and movable from a first position remote from the wall of said cavity to a second position adjacent said wall of said cavity whereby said partial vacuum may be applied through said openings to a sheet supported on said sheet transport surface when said shield means is in said first position, and said partial vacuum is prevented from being applied through a number of said openings adjacent said deflector plate when said shield means is in said second position, and means for selectively moving said vacuum shield means between said first and second positions, whereby a sheet on said cylindrical sheet transport surface is retained thereon when said shield means is in said first position and a sheet on said cylindrical sheet transport surface deflects outward therefrom to contact said stationary deflection plate when said shield means is in said second position.

2. The apparatus of claim 1 wherein said vacuum shield means comprises a curved shield plate fittable against the wall of said cavity.

3. The apparatus of claim 1 wherein said means for selectively moving said vacuum shield means comprises a solenoid actuator mounted within said drum cavity and attached to said vacuum shield means.

4. The apparatus of claim 1 wherein said means for rotating said drum comprises a roller, said roller being disposed such that the longitudinal axis of said roller is parallel with respect to the longitudinal axis of said drum, means for rotating said roller, and a plurality of sheet transporting belts, extending between and around said roller and said drum, such that rotation of said roller rotatably drives said belts and said drum.

5. The apparatus of claim 4 wherein said means for rotating said roller comprises a roller pulley connected to said roller, a motor having a drive shaft, a drive pulley mounted on said drive shaft, and a drive belt, extending between said drive pulley and said roller pulley, such that said motor rotatably drives said roller.

* * * * *

UNITED STATES PATENT AND TRADEMARK OFFICE

CERTIFICATE OF CORRECTION

PATENT NO. : 4,474,367

DATED : October 2, 1984

INVENTOR(S) : Henry W. Jongerling and Svetislav Mitrovich

It is certified that error appears in the above-identified patent and that said Letters Patent is hereby corrected as shown below: Title page:

In the Abstract, line 3, before "vacuum" insert --a--.

Col. 2, line 17, "August 2" should be --August 12--.

Col. 3, line 10, delete "15".

Col. 3, line 44, delete "15".

Col. 4, line 32, "2" should be --12--.

Col. 6, line 4, delete "15".

Col. 6, line 5, new paragraph should begin with "Upon".

Col. 6, lines 51-52, "opening" should be --openings--.

Col. 6, line 67, delete "a".

Signed and Sealed this

*Sixteenth* Day of *April 1985*

[SEAL]

*Attest:*

DONALD J. QUIGG

*Attesting Officer* *Acting Commissioner of Patents and Trademarks*